US008857302B2

(12) United States Patent
Kani et al.

(10) Patent No.: US 8,857,302 B2
(45) Date of Patent: Oct. 14, 2014

(54) LATERALLY ADJUSTABLE BLADE COVER FOR USE WITH A CUTTING TOOL

(75) Inventors: Toshiyuki Kani, Anjo (JP); Yoshihiro Kimura, Anjo (JP)

(73) Assignee: Makita Corporation, Anjo-shi (JP)

( * ) Notice: Subject to any disclaimer, the term of this patent is extended or adjusted under 35 U.S.C. 154(b) by 376 days.

(21) Appl. No.: 13/111,031

(22) Filed: May 19, 2011

(65) Prior Publication Data

US 2011/0283857 A1 Nov. 24, 2011

(30) Foreign Application Priority Data

May 24, 2010 (JP) ..... 2010-118068

(51) Int. Cl.

| | |
|---|---|
| ***B26D 5/00*** | (2006.01) |
| ***B27B 5/18*** | (2006.01) |
| ***B26D 1/14*** | (2006.01) |
| ***B26D 7/00*** | (2006.01) |
| ***B27G 19/02*** | (2006.01) |

(52) U.S. Cl.

CPC ..... *B27G 19/02* (2013.01)
USPC ..... 83/397.1; 83/471.3; 83/478; 83/520

(58) Field of Classification Search

USPC ..... 83/478, 471.3, 473, 490, 397, 397.1, 83/398, 471.2, 472, 504, 520, 421, 860; 409/134; 30/391, 390

See application file for complete search history.

(56) References Cited

U.S. PATENT DOCUMENTS

| | | | | |
|---|---|---|---|---|
| 2,466,325 | A * | 4/1949 | Ocenasek | 83/102.1 |
| 2,984,268 | A * | 5/1961 | Vuichard | 83/68 |
| 3,705,611 | A * | 12/1972 | Sakamoto | 83/478 |
| 4,805,504 | A | 2/1989 | Fushiya et al. | |
| 5,287,779 | A * | 2/1994 | Metzger, Jr. | 83/102.1 |
| 5,531,147 | A * | 7/1996 | Serban | 83/478 |
| 5,918,522 | A * | 7/1999 | Benedict et al. | 83/478 |
| 6,247,880 | B1 * | 6/2001 | Barcome | 409/134 |
| 6,854,937 | B1 * | 2/2005 | Weiss | 409/137 |
| 6,971,297 | B1 * | 12/2005 | Meredith et al. | 83/478 |
| 6,976,764 | B2 * | 12/2005 | Cheng et al. | 362/89 |
| 7,302,878 | B2 * | 12/2007 | Chang | 83/102.1 |
| 7,926,398 | B2 * | 4/2011 | Garcia et al. | 83/520 |
| 8,006,727 | B1 * | 8/2011 | Urban et al. | 144/329 |

(Continued)

FOREIGN PATENT DOCUMENTS

| | | |
|---|---|---|
| EP | 1 800 782 A2 | 6/2007 |
| EP | 1 839 828 A2 | 10/2007 |

(Continued)

OTHER PUBLICATIONS

Russian Office Action issued in Russian Application No. 2011120803/02(030724) dated Aug. 16, 2012 (w/translation).

(Continued)

*Primary Examiner* — Sean Michalski
*Assistant Examiner* — Jonathan G Riley
(74) *Attorney, Agent, or Firm* — Oliff PLC

(57) ABSTRACT

A cutting tool includes a tool unit having a rotary circular blade, a movable cover mounted to the tool unit and having a cover body movable in a moving direction to cover and uncover a part of the rotary circular blade by the cover body, and a position adjusting mechanism configured to adjust the position of the cover body of the movable cover in an adjusting direction different from the moving direction.

11 Claims, 6 Drawing Sheets

(56) References Cited

U.S. PATENT DOCUMENTS

| | | | | |
|---|---|---|---|---|
| 2003/0172789 | A1* | 9/2003 | Chen | 83/522.15 |
| 2005/0045013 | A1 | 3/2005 | Stumpf et al. | |
| 2005/0211039 | A1* | 9/2005 | Lo et al. | 83/477.2 |
| 2006/0101960 | A1* | 5/2006 | Smith et al. | 83/58 |
| 2009/0235794 | A1 | 9/2009 | Inai | |
| 2010/0058908 | A1* | 3/2010 | O'banion et al. | 83/102.1 |
| 2010/0242700 | A1 | 9/2010 | Cox | |
| 2010/0251871 | A1* | 10/2010 | Marsic et al. | 83/860 |
| 2011/0061247 | A1* | 3/2011 | Cheng | 30/391 |
| 2012/0097004 | A1* | 4/2012 | Marinov et al. | 83/471.2 |
| 2012/0103156 | A1* | 5/2012 | Li | 83/520 |

FOREIGN PATENT DOCUMENTS

| | | | |
|---|---|---|---|
| EP | 1 902 822 | A1 | 3/2008 |
| JP | I-57-101005 | | 12/1955 |
| JP | A-10-34431 | | 2/1998 |
| JP | A-2009-226526 | | 10/2009 |

OTHER PUBLICATIONS

Extended European Search Report issued in European Application No. 11167127.7 dated Jan. 18, 2013.

Nov. 26, 2013 Japanese Office Action issued in Japanese Patent Application No. 2010-118068 (with translation).

* cited by examiner

LATERALLY ADJUSTABLE BLADE COVER FOR USE WITH A CUTTING TOOL

This application claims priority to Japanese patent application serial number 2010-118068, the contents of which are incorporated herein by reference.

BACKGROUND OF THE ON INVENTION

1. Field of the Invention

The present invention relates to cutting tools having a cutting unit including a circular blade and a movable cover that can move to open and close a part of the circular blade.

2. Description of the Related Art

A known desktop-type circular saw has a table for placement of a workpiece and a tool unit. The tool unit has a rotary circular saw blade and is vertically movable relative to the table, so that the workpiece is out by the saw blade by downwardly moving the tool unit.

The technique relating to this kind of cutting tool is disclosed, for example, in Japanese Laid-Open Patent Publication No. 2009-226526. A tool unit of a desktop-type circular saw disclosed in this publication includes a unit case and an electric motor. The unit case rotatably supports a saw blade. The electric motor serves as a drive source. A movable cover covers the cutting edge of the saw blade within a range of an upper half of the circumferential length of the saw blade. The movable cover is opened in conjunction with the downward movement of the tool unit and is closed in conjunction with the upward movement of the tool unit. As the movable cover is opened in conjunction with the downward movement of the tool unit, a workpiece is cut by the exposed part of the saw blade.

However, in general, this kind of movable cover has a unique shape having a fishhook-like vertical cross sectional configuration that is not symmetrical in the right and left direction. The movable cover has a fan-like side view as viewed in an axial direction of the rotational axis of the saw blade. Therefore, in the case that the movable cover is molded by resin, the size and shape of the movable cover may not be always stable. For example, in some case, the movable cover may be positioned to be excessively close to the fixed cover when it is assembled. As a result, it is necessary to improve the molding accuracy or to strictly control the size. This may lead to increase the manufacturing cost.

Therefore, there is a need in the art for enabling the movable cover to be suitably positioned relative to the saw blade and the fixed cover.

SUMMARY OF THE INVENTION

According to the present teaching, a cutting tool includes a tool unit having a rotary circular blade, a movable cover mounted to the tool unit and having a cover body movable in a moving direction to cover and uncover a part of the rotary circular blade by the cover body, and a position adjusting mechanism configured to adjust the position of the cover body of the movable cover in an adjusting direction different from the moving direction.

DETAILED DESCRIPTION OF THE INVENTION

Figure 1:
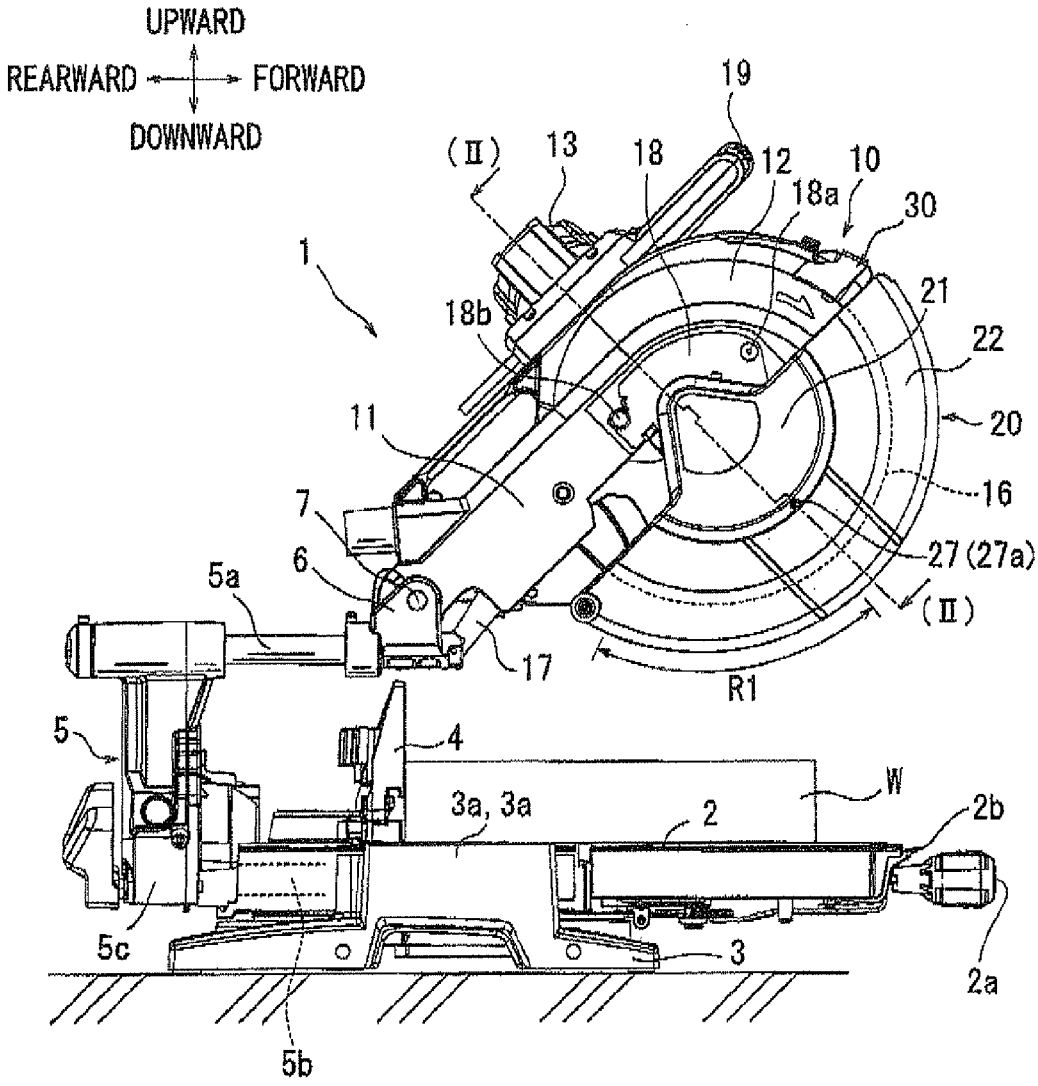
FIG. 1 is a side view of an entire cutting tool incorporating a position adjusting mechanism according to an example.

Each of the additional features and teachings disclosed above and below may be utilized separately or in conjunction with other features and teachings to provide improved position adjusting mechanisms for movable covers of cutting tools and cutting tools incorporating such improved position adjusting mechanisms. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings. Various examples will now be described with reference to the drawings.

In one example, a cutting tool includes a table for supporting a workpiece, a tool unit vertically movable relative to the table and having a rotary circular blade, and a movable cover mounted to the tool unit and having a cover body movable in a moving direction to cover and uncover a lower portion of a cutting edge of the rotary circular blade in conjunction with the vertical movement of the tool unit. A position adjusting mechanism is configured to adjust the position of the cover body of the movable cover in an adjusting direction substantially parallel to a direction of thickness of the rotary circular blade.

Therefore, by adjusting the position of the cover body of the movable cover in the adjusting direction after the movable cover has been assembled, it is possible to properly position the cover body relative to the circular blade and a fixed cover of the tool unit.

If the movable cover is a one-piece member, it is possible to compensate for an error in size of the movable cover after the assembling operation. If the movable cover is constituted by two or more parts, it is possible to compensate for errors in sizes of the parts and an accumulative error in assembling the parts. Therefore, it is possible to avoid an undesirable interaction of the movable cover with the fixed cover after the assembling operation. Hence, high accuracy in size of the one-piece movable member is not required. Similarly, high accuracy in sizes of the parts of the movable cover or high accuracy in assembling the parts is not required. As a result, it is possible to lower the manufacturing cost of the movable cover and to reduce the time required for the assembling operation.

The position adjustment mechanism has an additional function to the above function of compensating for errors caused during the manufacturing or assembling the movable cover. For example, in general, in this kind of cutting tool, in order to accurately perform the cutting operation, a cut line is marked on a workpiece prior to the cutting operation, and the workpiece is fixed in position on the table after positioning the workpiece such that the cut line is aligned with the circular blade. The operator may position the workpiece for alignment of the cut line with the circular blade while he or she visually recognizes the actual position of the cut line relative to the cutting edge of the circular blade by downwardly moving the tool unit toward the workpiece. However, it is difficult to suitably position the workpiece if the work is performed in a dark place. Therefore, in recent years, there has been proposed to use a laser oscillator that is mounted to a tool unit and irradiates a laser beam to a marked line on a workpiece, so that the workpiece can be positioned relative to a saw blade with reference to the laser beam. With this technique, it is possible to rapidly and accurately position the workpiece. In addition, it is not necessary to downwardly move the tool unit for the positioning operation. Therefore, the operability of the cutting tool is improved.

In the case that the laser oscillator is used for positioning the workpiece, the laser oscillator is normally mounted to a front end of a blade case on the upper side of the circular blade in order that the leaser beam can be irradiated to the workpiece placed on a table when the cutting unit is positioned at its uppermost rest position. Therefore, the laser beam is necessary to be radiated onto the upper surface of the workpiece after passing through a position on a front side of the saw blade and through a movable cover. To this end, a transmission window for allowing passage of the laser beam is formed in the movable cover. In general, the transmission window has a narrow width, such as a few millimeters, and is elongated along the circumferential edge of the movable cover. Because of the laser beam passes through the transmission window, the marked line can be aligned with the laser beam radiated at a high illumination intensity, so that the positioning operation can be rapidly accurately performed.

By incorporating the position adjusting mechanism in the widthwise direction of the movable cover into the tool unit having the laser oscillator and the transmission window formed in the cover body of the movable cover, it is possible to also adjust the position in the widthwise direction of the transmission window. Therefore, it is possible to reliably transmit the laser beam onto the workpiece through the transmission window. Hence, the position adjusting mechanism is further advantageous in the case that the laser beam is used for positioning the workpiece.

The tool unit may farther include a fixed cover covering an upper portion of the cutting edge of the rotary circular blade, and a cover plate mounted to the fixed cover and movably supporting the movable cover. The movable cover may include a support base rotatably supported by the cover plate, and the support base supports the cover body. The position adjusting mechanism may be provided between the support base and the cover body and/or between the fixed cover and the cover plate.

With this arrangement, the position adjusting mechanism is provided between parts of the cutting tool, whose positions are not changed relative to each other during a normal operating condition. Therefore, the adjustment of the position can be reliably performed. In general, the fixed cover has an arc-shaped central opening that enables access to the circular blade mounted to a spindle, so that the operation for mounting the circular blade to the spindle and the operation for removing the circular blade from the spindle can be performed through the central opening. During a normal condition where the mounting or removing operation of the circular blade is performed, the central opening is covered by the cover plate that rotatably supports the movable cover for covering and uncovering the lower portion of the cutting edge of the circular blade.

The support base may be made of non-transparent resin, whereas the cover body may be made of transparent resin. The support base and the cover body may be joined to each other to constitute the movable cover. Therefore, during the normal operating condition, the positions of the support base and the cover body may not changed relative to each other. Hence, the adjustment of position of the movable cover in the widthwise direction relative to the saw blade and the fixed cover can be reliably performed. Further, it is possible to reliably prevent the position of the movable cover from being displaced after it has been once adjusted.

The position adjusting mechanism may include an adjusting screw movable in the adjusting direction. With this construction, the position adjusting mechanism can be configured to be simple in construction and to be lower in manufacturing cost.

An example will now be described with reference to the drawings. Referring to FIG. 1, there is shown a cutting tool 1 incorporating a position adjusting mechanism according to this example. In this example, the cutting tool 1 is configured as a desktop-type circular saw called a slide circular saw. In order to operate the cutting tool 1, an operator may be positioned on the right side of the cutting tool 1 as viewed in FIG. 1. In this specification, for the purpose of explanation, the side nearer to the operator will be called as a front side. Also, a left side and a right side in this specification are those as viewed from the side of the operator.

The cutting tool 1 generally includes a turntable 2 for placement of a workpiece W thereon, a base 3 horizontally rotatably supporting the turntable 2, a fence 4 for positioning the workpiece W within a horizontal plane parallel to an upper surface of the turntable 2, and a unit support 5 for supporting a tool unit 10 at a position above the turntable 2, The rotational position of the turntable 2 can be adjusted and locked by operating a tack knob 2*a* or a lock lever 2*b* disposed at a front portion of the turntable 2. A pair of auxiliary tables 3*a* are disposed on the left and right sides of the turntable 2 and are fixed in position relative to the base 3. The fence 4 extends between the left and right auxiliary tables 3*a*. In order to position the workpiece W relative to the turntable 2, the workpiece W may be brought to contact with the fence 4.

The unit support 5 is disposed at the rear portion of the turntable 2 and includes an upper and lower two-stage slide mechanisms 5*a* and 5*b* and a left and right tilt mechanism 5*c*. The upper and lower two-stage slide mechanisms 5*a* and 5*b* allow the tool unit 10 to be moved horizontally in forward and rearward directions by a large stroke of movement. The left and right tilt mechanism Sc allows the tool unit 10 to be tilted leftward or rightward for performing a cutting operation called an inclined cutting operation.

The tool unit 10 is supported on a front end of the upper slide mechanism 5*a* via a support bracket 6. More specifically, a support shaft 7 of the support bracket 6 vertically pivotally supports the tool unit 10.

The tool unit 10 has a unit case 11. The support shaft 7 vertically pivotally supports the rear portion of the unit case 11. A fixed cover 12 is provided on a front portion of the unit case 11 and covers a substantially upper half in the circumferential direction of the circular cutting blade 16. In this example, the cutting blade 16 is a saw blade. A handle 19 is provided on a rear surface of the fixed cover 12. The handle 19 is sized so as to be capable of being grasped by the operator. An electric motor 13 is also mounted to the rear surface of the fixed cover 12. The rotation of the motor 13 is transmitted to a spindle 15 via a reduction gear train 14 (see FIG. 2). The cutting blade 16 is mounted to the spindle 15 and is axially clamped between a fixing flange 15*a* and a support flange 15*b*. The fixing flange 15*a* can be removed from the spindle 15 by loosening a fixing screw 15*c*, so that the cutting blade 16 can be removed from the spindle 15.

A movable cover 20 covers a substantially lower half in the circumferential direction of the circular cutting blade 16 and can be opened and closed in conjunction with the vertical movement of the tool unit 10 by means of an actuation lever 17 interposed between the unit case 11 and the unit support bracket 6. When the cutting unit 10 is positioned at an upper rest position shown in FIG. 1, the movable cover 20 is positioned at a close position, so that the entire circumference of the cutting blade 16 is covered by the fixed cover 12 and the movable cover 20. The movable cover 20 is biased toward the close position by a torsion spring 25 interposed between the movable cover 20 and a cover plate 18 that will be explained later.

As the tool unit 10 pivots vertically downward, the actuation lever 17 pivots to change the position of its front end on the side of the unit case 11, so that the front end of the actuation lever 17 pushes the movable cover 20 toward an open position of the movable cover 20, When the tool unit 10 reaches its lower stroke end, the movable cover 20 is positioned at the open position for uncovering the substantially lower half of the circular cutting blade 16.

The movable cover 20 is supported by the fixed cover 12 via the cover plate 18 so as to be movable along the cutting edge of the cutting blade 16. The cover plate 18 is vertically pivotally mounted to the left side portion of the fixed cover 12 via a support shaft 18*a*. The cover plate 18 can be fixed in position relative to the fixed cover 12 by tightening a fixing screw In. The cover plate 18 can be allowed for pivotal movement by loosening the fixing screw 18*b*. As the cover plate 18 pivots downward, the left side portion of the fixed cover 12 opposed to the left side axial end of the spindle 15 is opened, and the movable cover 20 can be pivoted forwardly by a large distance. Therefore, it is possible to easily mount and remove the cutting blade 16 to and from the spindle 15 by tightening and loosening the fixing screw 15*c*. The cover plate 18 is normally fixed in position for closing the left side opening of the fixed cover 18 axially opposed to the spindle 15.

Figure 2:
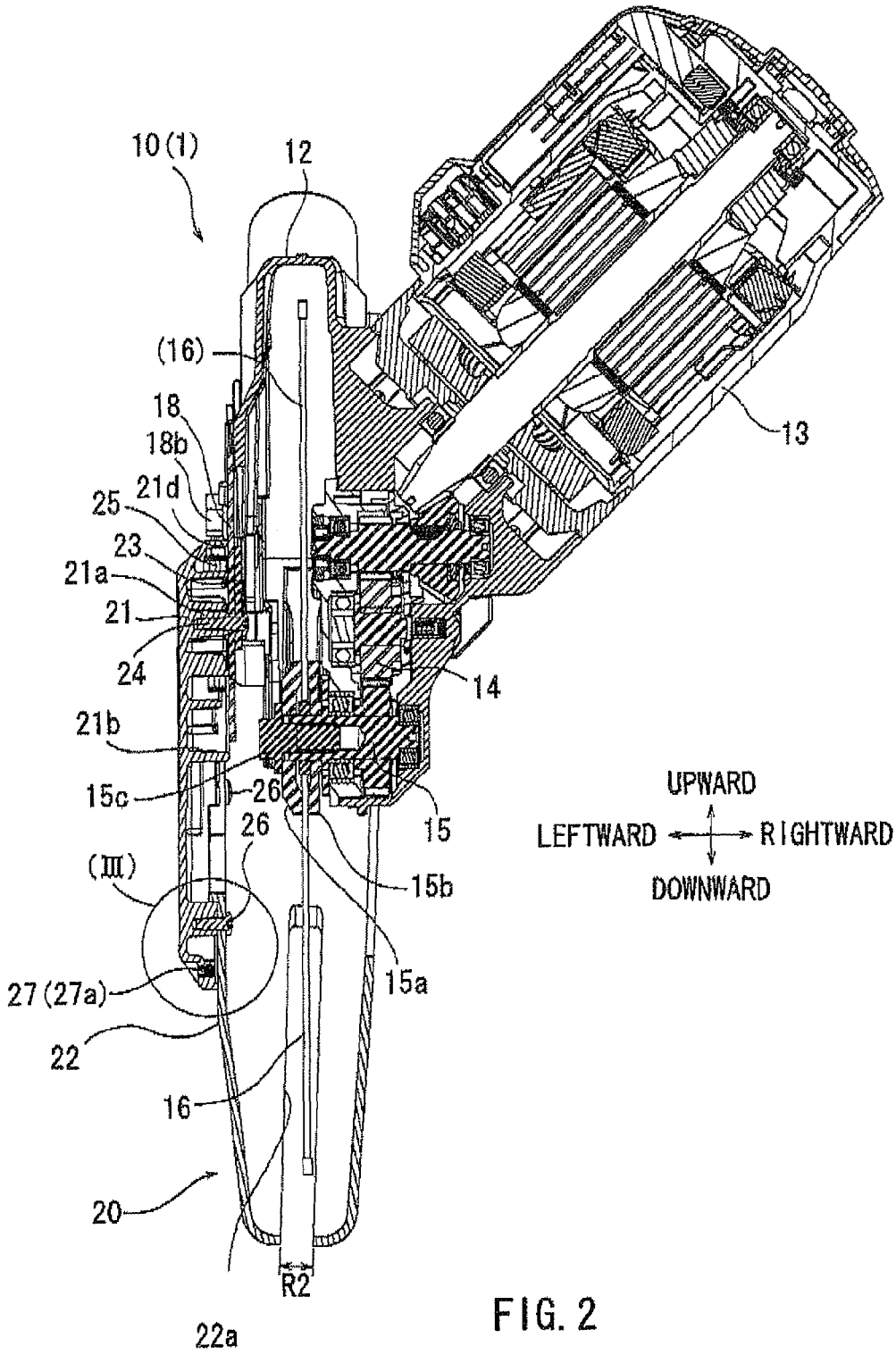
FIG. 2 is a sectional view taken along line II-II in FIG. 1 and showing a vertical sectional view of a tool unit.
Figure 6:
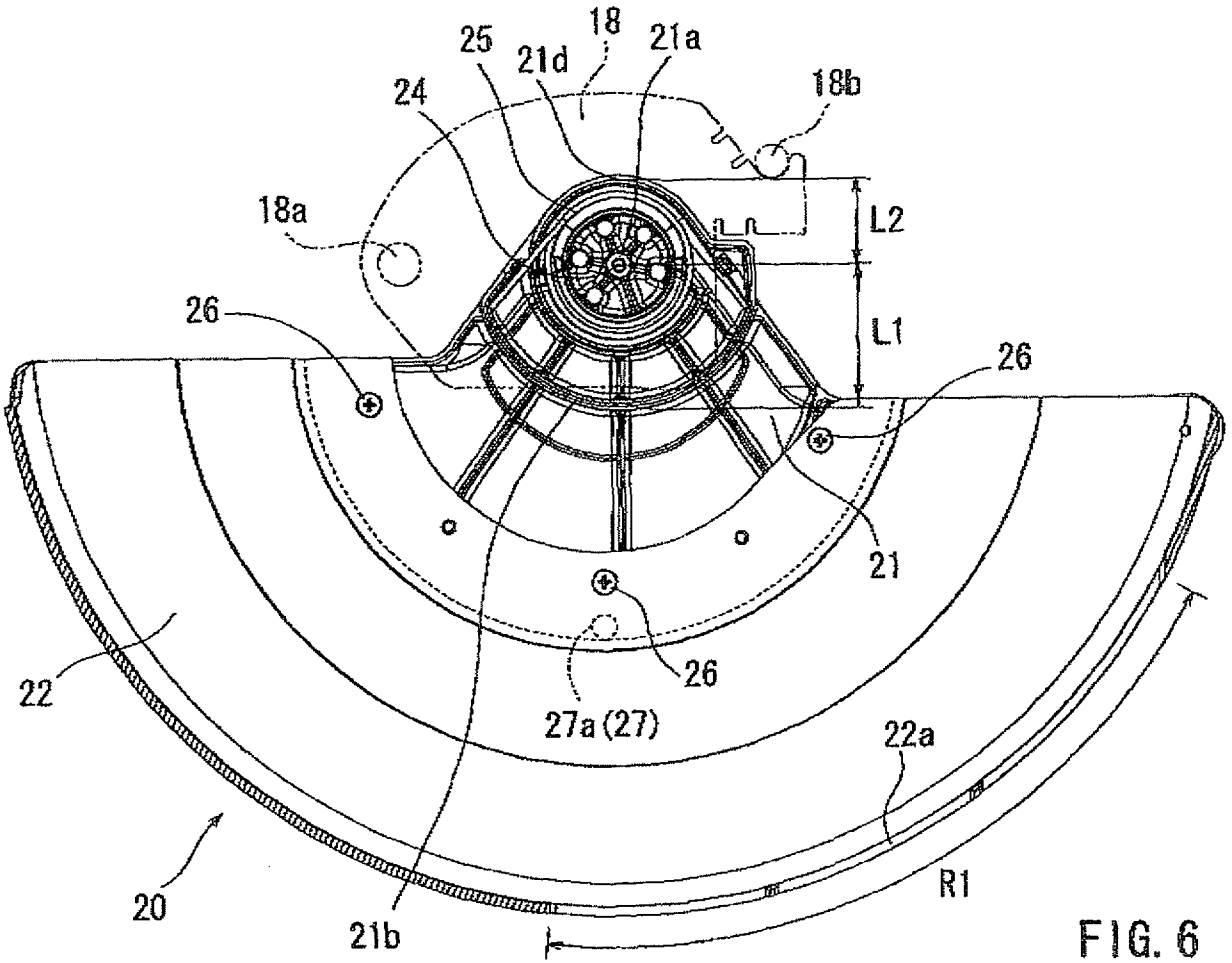
FIG. 6 is a right side view of the movable cover.

The cover plate 18 pivotally supports the movable cover 20. As shown in FIG. 1, the movable cover 20 has a substantially fan-shaped central support base 21 and a cover body 22 extending radially outward from the support base 21. In this example, the support base 21 is an aluminum die-cast product, whereas the cover body 22 is made of transparent resin material. The cover body 22 is fixedly joined to the support base 21 by using three fixing screws 26, More specifically, as shown in FIGS. 2 and 6, a support boss 21*a* is provided on an upper portion of the left side surface of the support base 21. With the cover plate 18 clamped in its thickness direction between the support boss 21*a* and an auxiliary plate 23, the cover plate 18, the support boss 21*a* and the auxiliary plate 23 are coupled together by a rotary support shaft 24. The rotary support shaft 24 supports the movable cover 20 so as to be rotatable relative to the cover plate 18 and eventually relative to the fixed cover 12.

A lower guide rib 21*b* is formed on the right side surface of the support base 21 at a position on the lower side of the support boss 21*a*. The lower guide rib 21*b* extends along an arc about the axis of the support boss 21*a*. Around the support boss 21*a*, there is formed an upper guide rib 21*d* having an annular shape about the axis of the support boss 21*a* with a radius smaller than that of the arc of the lower guide rib 21*b*. The lower guide rib 21*b* and the upper guide rib 21*d* can slidably contact the cover plate 18, so that the rotational axis of the movable cover 20 is held parallel to the axis of the spindle 15. Therefore, the movable cover 20 is prevented from being inclined and from being displaced in its widthwise direction (the left and right direction as viewed in FIG. 2 in this example) relative to the fixed cover 12 and the cutting blade 16. In this example, the widthwise direction is parallel to the rotational axis of the movable cover 20.

Figure 3:
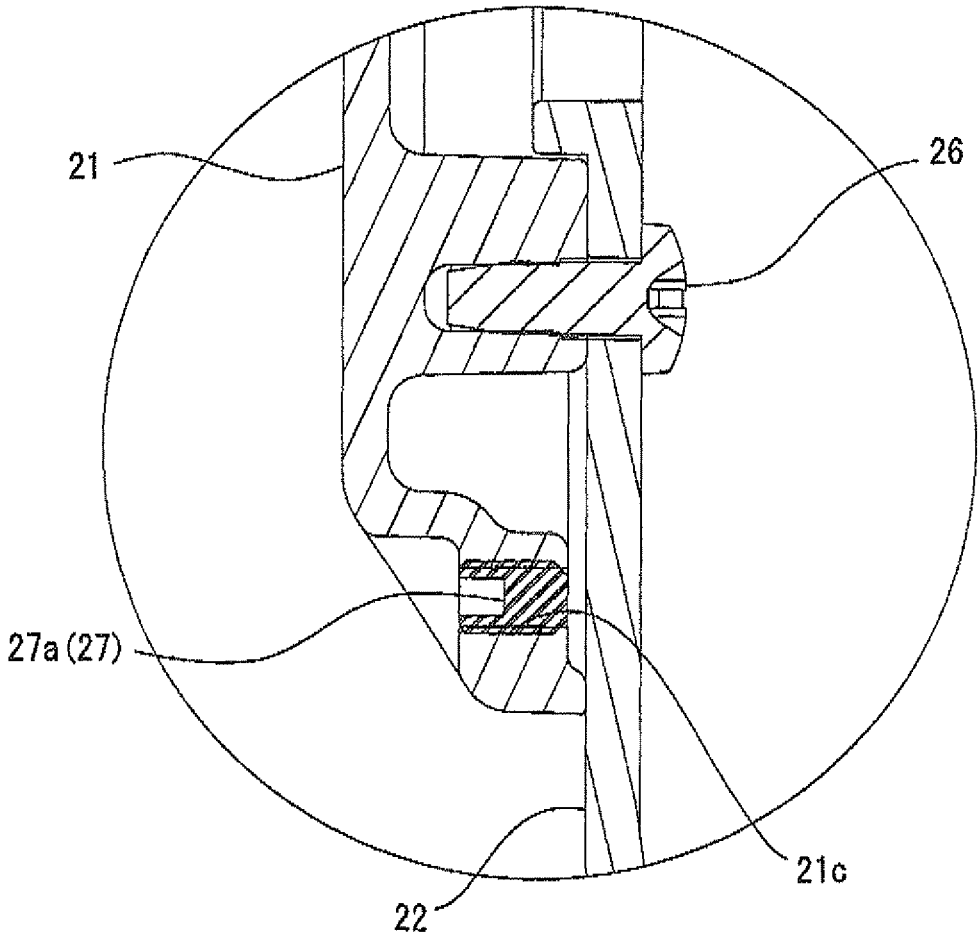
FIG. 3 is an enlarged view of a region III in FIG. 2 and showing a vertical sectional view of the position adjusting mechanism.

If the movable cover 20 is displaced in the widthwise direction from a proper position or if the movable cover 20 is inclined, it may be possible that the movable cover 20 interacts with the fixed cover 12. Therefore, in this example, a position adjusting mechanism 27 is provided for adjusting the widthwise position of the movable cover 20. The position adjusting mechanism 27 has an adjusting screw 27*a* as a primary component. The adjusting screw 27*a* is mounted to the lower portion of the support base 21, More specifically, as shown in FIG. 3, the adjusting screw 27*a* is threadably engaged with a threaded hole 21*c* formed in the lower portion of the support base 21.

As the tightening amount of the adjusting screw 27*a* into the threaded hole 21*c* increases or as the adjusting screw 27*a* is rotated to move rightward, the end portion of the adjusting screw 27*a* is brought to contact the cover body 22 so as to push the cover body 22, so that the cover body 22 is displaced rightward due to its resilient deformation. On the other hand, as the tightening amount of the adjusting screw 25*a* decreases or the adjusting screw 27*a* is rotated to move leftward, the cover body 22 moves leftward by the resilient restorative force. In this example, a small set screw with a non-enlarged hexagon socket head is used as the adjusting screw 27*a*. The tightening amount of the adjusting screw 27*a* can be adjusted by engaging a hexagon wrench (not shown) with the hexagon socket of the adjusting screw 27*a* and rotating the hexagon wrench.

In this way, because the position in the widthwise direction of the cover body 22 relative to the cover support 21 and the fixed cover 12 can be finely adjusted, it is possible to prevent potential interaction of the movable cover 20 with the fixed cover 12. In addition, the position in the widthwise direction of the movable cover 20 can be adjusted by the position adjusting mechanism 27 even after the movable cover 20 has been assembled. Therefore, it is possible to compensate for errors in size or in assembling of the support base 21 and the cover body 22 and to compensate for accumulative errors caused during assembling of the support base 21 to the cover plate 18 and eventually to the fixed cover 12 even after the assembling operation. Hence, high accuracy in sizes of the parts of the movable cover 20 is not necessary. Similarly, high accuracy in assembling the parts is not necessary. As a result, it is possible to lower the manufacturing cost and to reduce the time required for the assembling operation.

In addition to the function of preventing interaction of the movable cover 20 with the fixed cover 12, the position adjusting mechanism 27 may have an additional function as will be explained below.

At the circumferential edge of the cover body 22, a transmission window 22*a* is formed throughout its thickness for allowing passage of a lager beam emitted from a laser oscillator 30. As shown in FIGS. 1 and 6, the transmission window 22*a* is elongated to extend over a region R1 along the circumferential edge of the cover body 22. As shown in FIG. 2, the transmission window 22*a* has a width R2 that is relatively small. For example, the width R2 may be about 10 mm.

The laser oscillator 30 is mounted to the front portion of the fixed cover 12. The laser oscillator 30 emits a laser beam in a direction substantially downwardly therefrom so as to radiate the laser beam onto a line (not shown) marked on the upper surface of the workpiece W. Thus, the laser beam emitted from the laser oscillator 30 is radiated onto the marked line on the upper surface of the workpiece W after passing through the transmission window 22*a* of the movable cover 22. Therefore, if the movable cover 20 is not properly positioned in the widthwise direction relative to the fixed cover 12 of the cutting blade 16, the position of the transmission window 22*a* may be offset relative to a path of transmission of the laser beam. In such a case, it may be possible that the laser beam is interrupted by a part of the fixed cover 12 having no transmission window 22*a* because the width R2 is relatively small. When this occurs, it is difficult to position the workpiece W with reference to the laser beam. However, this problem can be solved by the position adjusting mechanism 27.

Thus, by changing the tightening amount of the adjusting screw 27*a*, it is possible to shift the cover body 22 in the widthwise direction (right and left direction) relative to the support base 21. With this operation, it is possible to finely adjust the position of the transmission window 22*a* in the widthwise direction relative to the cuffing blade 16 and eventually relative to the transmission path of the laser beam.

FIG. 2 shows the state where the cutting blade 16 is displaced rightward relative to the central longitudinal axis of the transmission window 22*a*. Therefore, the transmission path of the laser beam is offset toward the same side as the cutting blade 16 because the transmission path is set to be within a central plane of the cutting blade 16 extending centrally of the cutting blade 16 with respect to its thickness. In this case, it may be possible that the laser beam is interrupted not to pass through the transmission window 22*a* and that the workpiece W cannot be positioned with reference to the laser beam.

Figure 4:
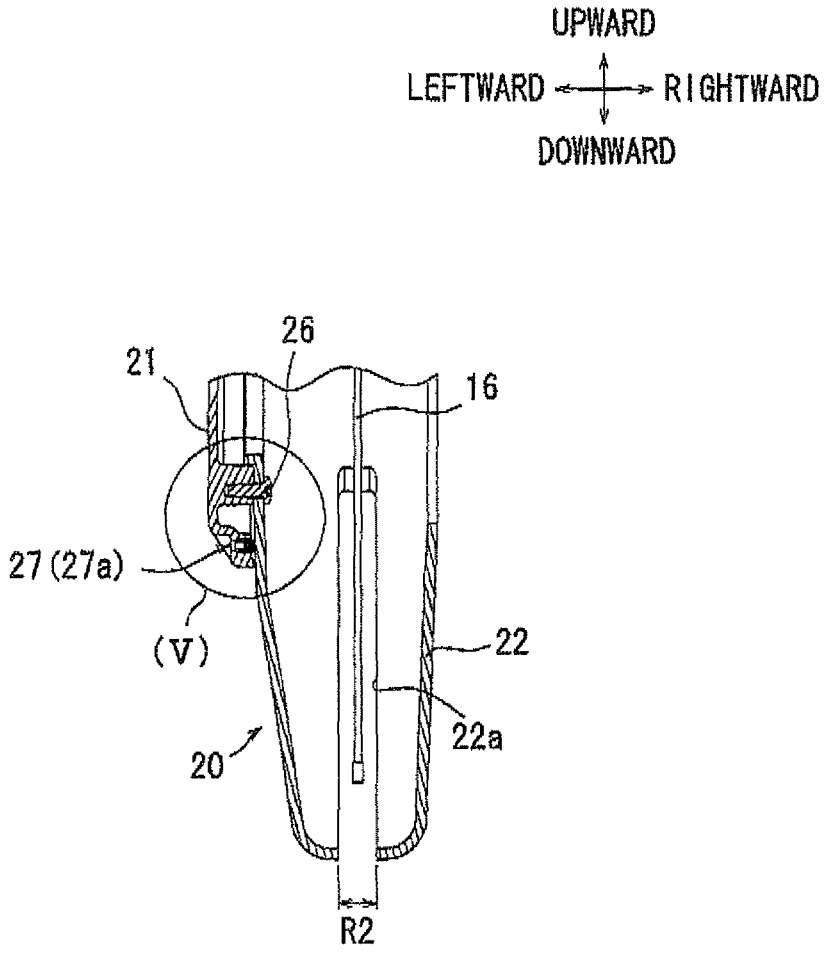
FIG. 4 is a vertical sectional view of a lower portion of a movable cover including the position adjusting mechanism.
Figure 5:
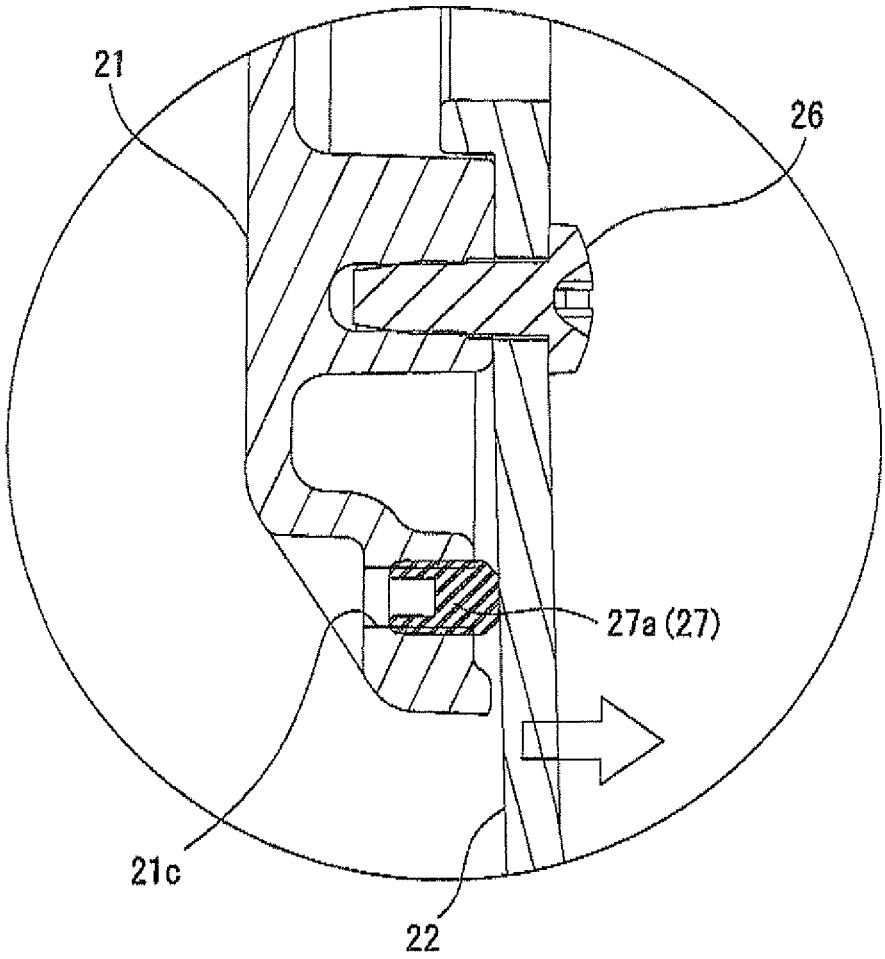
FIG. 5 is an enlarged view of a region V in FIG. 4 and showing a vertical sectional view of the position adjusting mechanism when the position of the movable cover is shifted rightward by the position adjusting mechanism.

In such a case, the tightening amount of the adjusting screw 27*a* of the position adjusting mechanism 27 may be increased to shift the cover body 22 rightward (away from the support base 21) by a little distance as indicated by an outline arrow in FIG. 5. With this adjustment, the transmission window 22*a* can be appropriately positioned relative to the cutting blade 16 and eventually relative to the transmission path of the laser beam as shown in FIG. 4. In the state shown in FIG. 4, the cutting blade 16 is positioned substantially centrally of the width R2 of the transmission window 22*a* as a result of adjustment of the tightening amount.

With the cutting blade 16 positioned centrally of the transmission window 22*a* as shown in FIG. 4 and with the transmission path of the laser beam also positioned centrally of the transmission window 22*a*, the laser beam can be effectively radiated to the marked line on the workpiece W without being interrupted by the cover body 22. As a result, the positioning of the workpiece W can be rapidly efficiently performed, Preferably, the adjustment of position of the movable cover 20 by the position adjusting mechanism 27 is performed in the state that the tool unit 10 is tilted leftwardly by the left and right tilt mechanism 5*c* of the unit support 5. In order to ensure a smooth opening and closing movement of the movable cover 20, a suitable clearance is normally provided between the cover plate 18 and the upper and lower guide ribs 21*d* and 21*b* of the support base 21. Therefore, when the tool unit 10 is tilted leftward, the movable cover 20 may tend to be shifted in the widthwise direction due to its gravity, so that its circumferential side moves downward by a distance corresponding to the clearance. In other words, the movable cover 20 tilts relative to the fixed cover 12.

In such a case, because the cover body 22 tilts relative to the support base 21, the lower guide rib 21*b* moves in a direction of being raised relative to the cover plate 18, whereas the upper guide rib 21*d* moves in a direction of being pressed against the cover plate 18. As shown in FIG. 6, a distance L1 between the rotary support shaft 24 and the lower guide rib 21*b* is set to be larger than a distance L2 between the rotary support shaft 24 and the upper guide rib 21*d*. Therefore, the function of the lower guide rib 21*b* for restricting the tilting movement of the movable cover 20 relative to the fixed cover 12 or the cutting blade 16 is more effective than that provided by the upper guide rib 21*d*.

Incidentally, when the tool unit 10 is tilted leftward, the upper guide rib 21*d* may be brought to contact the cover plate 18. However, if the lower guide rib 21*b* is raised relative to the cover plate 18 by the distance corresponding to the above clearance, the circumferential edge of the cover body 22 may be displaced by a large distance, resulting in that the movable cover 20 is inclined relative to the fixed cover 12 or the cutting blade 16 by a large angle. For this reason, in particular when the tool unit 10 is tilted leftward, there is a possibility that the movable cover 20 interacts with the fixed cover 12 during the opening and closing movement of the movable cover 20. In addition, it may be possible that the transmission window 22*a* of the cover body 22 is shifted in the widthwise direction relative to the cutting blade 16 and eventually relative to the transmission path of the laser beam.

For this reason, the operation for adjusting the position of the cover body 22 in the widthwise direction to a suitable position by adjusting the tightening amount of the screw 27*a* may preferably be performed in the state that the tool unit 10 is tilted leftward or in the state where there is a possibility that the movable cover 20 is shifted by a large distance in the widthwise direction relative to the cutting blade 16 or the laser transmission path.

When the tool unit 10 is positioned at a vertical position, the gravity of the movable cover 20 is applied in a direction perpendicular to the rotary support shaft 24 (i.e., a vertical direction). Therefore, each of the lower guide rib 21*b* and the upper guide rib 21*d* may slidably contact the cover plate 18, while keeping a suitable clearance from the cover plate 18. Hence, the movable cover 20 may riot be tilted by a large angle. On the other hand, when the took unit 10 is tilted rightward, the lower guide rib 21*b* having the tilting movement restricting function of the tool unit 10, which function is more effective than the upper guide rib 21*d*, slidably contacts the cover plate 18. Therefore, in the ease that the tool unit 10 is tilted rightward, the resulted tilt angle may not be so large as in the case of the leftward tilting movement.

For the above reason, the position adjusting mechanism 27 can effectively adjust the position of the cover body 22 in the case that the adjusting operation is performed with the tool unit 10 tilted leftward.

As described above, the position adjusting mechanism 27 of this example can finely adjust the position of the movable cover 20 in the widthwise direction relative to the fixed cover 12. Therefore, it is possible to avoid potential interaction of the movable cover 20 with the fixed cover 20 during the opening and closing movement of the movable cover 20. Hence, it is possible to compensate for potential machining errors or potential assembling errors of parts of the movable cover 20, such as the support base 21 and the cove body 22, etc., after these components have been assembled. Therefore, high accuracy in sizes of the parts of the movable cover 20 and high accuracy in manufacturing the parts is no longer necessary. As a result, it is possible o lower the manufacturing cost and the assembling cost.

Further, adjustment of position of the cover body 22 in the widthwise direction by the position adjusting mechanism 27 leads to adjust the position of the laser beam transmission window 22*a* in the widthwise direction (i.e., the direction of thickness of the cutting blade 16). Therefore, the laser beam can be effectively radiated on the marked line of the workpiece W, so that the operation for positioning the workpiece W can be rapidly accurately performed.

The position adjustment mechanism 27 is advantageously operated in particular when the tool unit 10 is in a leftward tilted position where the movable cover 20 tends to be shifted in the widthwise direction due to its gravity.

The above example may be modified in various ways. For example, although the position adjustment mechanism 27 includes only one adjusting screw 27*a* in the above example, two or more adjusting screws 27*a* may be provided at different positions of the support base 21.

Further, although a set screw is used as the adjusting screw 27*a*, a hexagon bolt or any other threaded member can be used as the adjusting screw 27*a*.

Furthermore, the adjusting screw 27*a* and the threaded hole 21*c* into which the adjusting screw 27*a* is tightened can be replaced with a positioning pin and a pin receiving hole for receiving the positioning pin, respectively. In such a case, the adjustment of position of the cover body 22 in the widthwise direction can be made by adjusting the amount of insertion of the positioning pin into the pin receiving hole.

Furthermore, although the adjusting screw 27*a* is engaged with the support base 21 of the movable cover 20 and abuts to the cover body 22 for adjusting the position of the cover body 22 relative to the support base 21 in the above example, the adjusting screw 27*a* may be engaged with the cover plate 18 and abut to the fixed cover 12 for adjusting the position of the movable cover 20 relative to the fixed cover 12. Further, the position adjusting mechanism may be provided on both of the movable cover 20 and the fixed cove 12.

What is claimed is:

1. A cutting tool comprising:

a table for supporting a workpiece, a tool unit vertically movable relative to the table and having a rotary circular blade;

a movable cover mounted to the tool unit and having a cover body movable in a moving direction to cover and uncover a lower portion of a cutting edge of the rotary circular blade in conjunction with the vertical movement of the tool unit;

a cover plate movably supporting the movable cover; and a position adjusting mechanism configured to adjust the position of the cover body of the movable cover in an adjusting direction substantially parallel to a direction of thickness of the rotary circular blade, wherein:

the movable cover further includes a support base rotatably supported by the cover plate, and the position adjusting mechanism is configured to apply a pressing force against the cover body for causing resilient deformation of the cover body relative to the support base in a lateral direction.

2. The cutting tool as in claim 1, wherein:

the tool unit further includes a fixed cover covering an upper portion of the cutting edge of the rotary circular blade;

the cover plate is mounted to the fixed cover; and the cover body is supported by the support base.

3. The cutting tool as in claim 2, wherein the position adjusting mechanism is provided between the support base and the cover body.

4. The cutting tool as in claim 1, wherein the position adjusting mechanism includes a screw movable in the adjusting direction.

5. The cutting tool as in claim 1, further comprising a laser oscillator mounted to the tool unit, and wherein the cover body of the movable cover has a transmission window, so that a laser beam radiated from the laser oscillator is radiated onto a workpiece supported on the table after passing through the transmission window.

6. The cutting tool as in claim 1, wherein:

the cover body is made of resiliently deformable material, and the position adjusting mechanism is configured to apply a pressure against the cover body to cause resilient deformation of the cover body.

7. The cutting tool as in claim 2, wherein:

the cover body is made of resiliently deformable material, and the position adjusting mechanism includes a screw threadably engaged with the support base and has one end opposed to the cover body, so that the screw can apply the pressing force against the cover body for causing resilient deformation of the cover body.

8. A cutting tool comprising:

a tool unit having a rotary circular blade;

a movable cover mounted to the tool unit and having a cover body movable in a moving direction to cover and uncover a part of the rotary circular blade by the cover body;

a cover plate movably supporting the movable cover; and a position adjusting mechanism configured to adjust the position of the cover body of the movable cover in an adjusting direction different from the moving direction, wherein:

the movable cover further includes a support base rotatably supported by the cover plate, and the position adjusting mechanism is configured to apply a pressing force against the cover body for causing resilient deformation of the cover body relative to the support base in a lateral direction.

9. The cutting tool as in claim 8, wherein the adjusting direction is substantially parallel to a direction of thickness of the rotary circular blade.

10. The cutting tool as in claim 8, wherein the position adjusting mechanism comprises a screw.

11. The cutting tool as in claim 10, wherein:

the cover body is supported by the support base and is resiliently deformable; and the screw is threadably engaged with the support base and has one end opposed to the cover body, so that the screw can apply the pressing force against the cover body for causing resilient deformation of the cover body.

* * * * *